US007621786B2

(12) United States Patent
Yavari et al.

(10) Patent No.: US 7,621,786 B2
(45) Date of Patent: Nov. 24, 2009

(54) ELECTRICAL CONNECTORS AND MATING CONNECTOR ASSEMBLIES

(75) Inventors: Zia Yavari, Scottsdale, AZ (US); Dale Dwayne Emerson, Glendale, AZ (US)

(73) Assignee: Sealco Commerical Vehicle Products, Inc., Phoenix, AZ (US)

( * ) Notice: Subject to any disclaimer, the term of this patent is extended or adjusted under 35 U.S.C. 154(b) by 104 days.

(21) Appl. No.: 11/748,946

(22) Filed: May 15, 2007

(65) Prior Publication Data

US 2008/0287000 A1 Nov. 20, 2008

(51) Int. Cl.
*H01R 13/432* (2006.01)

(52) U.S. Cl. ..... 439/752.5; 439/314; 439/595; 439/948

(58) Field of Classification Search ..... 439/752.5, 439/682, 314, 319, 595, 603, 948
See application file for complete search history.

(56) References Cited

U.S. PATENT DOCUMENTS 3,478,302 A * 11/1969 Chirumbolo ..... 439/314
3,824,681 A * 7/1974 Clark ..... 29/593
3,957,337 A * 5/1976 Damiano ..... 439/682
4,284,313 A * 8/1981 Anhalt ..... 439/350
4,483,579 A * 11/1984 Derr et al. ..... 439/317
4,832,615 A 5/1989 Thakrar et al.
4,973,268 A * 11/1990 Smith et al. ..... 439/595
5,498,179 A * 3/1996 Byczek ..... 439/843
5,662,488 A * 9/1997 Alden ..... 439/314
5,816,864 A * 10/1998 Creelle ..... 439/752.5
6,010,348 A 1/2000 Alden
6,086,419 A 7/2000 Marpoe, Jr.
7,074,077 B2 * 7/2006 Sakaguchi et al. ..... 439/521
2002/0068479 A1 * 6/2002 Morello et al. ..... 439/595
2006/0172609 A1 8/2006 Wang et al.

* cited by examiner

*Primary Examiner*—Hien Vu
(74) *Attorney, Agent, or Firm*—Fennemore Craig, P.C.

(57) ABSTRACT

An electrical connector according to one embodiment of the invention may include a terminal body that defines an opening therein that includes a plurality of alignment ribs. An electrical terminal is positioned within the opening so that the plurality of alignment ribs align the electrical terminal within the opening in the terminal body.

17 Claims, 7 Drawing Sheets

ELECTRICAL CONNECTORS AND MATING CONNECTOR ASSEMBLIES

TECHNICAL FIELD

This invention relates to electrical connectors in general and more specifically to environmentally-resistant electrical connectors.

BACKGROUND

Numerous types of electrical connectors exist and have been used for decades to provide a removable electrical connection between various types of electrical components and devices. One type of removable electrical connector is known as a bayonet connector. Bayonet connectors were developed decades ago and are commonly used to interconnect single conductor cables, typically in low power, low voltage applications, such as those commonly used in truck and automotive electrical systems. However, bayonet connectors may be used in other applications as well.

A typical bayonet connector assembly may comprise a male terminal and a female terminal that are designed to be engaged and disengaged with one another. Both the male and female terminals are typically electrically and mechanically attached to an electrical conductor (e.g., a wire) by crimping, although they may also be soldered. Both types of terminals (e.g., the male and female terminals) are typically mounted within a housing or connector body that supports the terminals and electrically insulates them from one another and from their surroundings. However, most connector bodies do not seal the terminals from the environment, thereby subjecting the terminals to corrosion and other deleterious effects due to exposure to the surrounding environment. Of course, such environmental exposure is undesirable in applications where the environment contains corrosive agents (e.g., salts), such as, for example, in external automotive and commercial vehicle applications.

While several types of electrical connectors have been developed in an effort to protect the terminals from exposure to the environment, none are without their problems. For example, while some types of connectors are highly effective from a sealing standpoint, i.e., they are good at protecting the electrical terminals from exposure to the environment, such connectors tend to be expensive to produce or are difficult and/or time-consuming to connect and disconnect in service. Other types of connectors, while being of lower cost and easier to use, often fail to protect the electrical terminals from the deleterious effects of the environment. Still other types of connectors may work well when new, but tend to deteriorate rapidly and may be subject to in-service corrosion, which may lead to erratic performance.

SUMMARY OF THE INVENTION

An electrical connector according to one embodiment of the invention may include a terminal body that defines an opening therein that includes a plurality of alignment ribs. An electrical terminal is positioned within the opening so that the plurality of alignment ribs align the electrical terminal within the opening in the terminal body.

Also disclosed is a mating electrical connector pair that may include a first terminal body that defines an opening therein having a plurality of alignment ribs. A first type of electrical terminal is positioned within the opening so that the plurality of alignment ribs align the first type of electrical terminal within the opening in the first terminal body. A second terminal body defines an opening therein. A second type of electrical terminal is positioned within the opening of the second terminal body. The second type of electrical terminal is releasably engageable with the first type of electrical terminal.

Also disclosed is an electrical terminal that may include a generally elongate hollow portion having a proximal end and a distal end. The proximal end is adapted to receive an electrical conductor, whereas the distal end is sized to engage a mating electrical terminal. The proximal end of the electrical terminal is substantially closed to prevent material from migrating into the hollow portion of the electrical terminal.

A method for making an electrical terminal, may include: Providing a generally flat sheet of material comprising elements that, when elastically deformed, form a generally elongate hollow terminal having a proximal end and a distal end, the proximal end being adapted to receive an electrical conductor, the distal end being sized to engage a mating electrical terminal; and elastically deforming a tab provided on the generally flat sheet material so that the tab substantially closes the proximal end of the generally hollow terminal.

A method for fabricating an electrical connector may involve: Providing a terminal body defining an opening therein, the opening comprising a tapered portion having a wide end and a narrow end; providing an electrical terminal having an electrical conductor attached thereto; inserting the electrical terminal within the opening so that the narrow end of the tapered portion contacts the electrical terminal; and molding a sleeve over the terminal body so that the sleeve encapsulates at least a portion of the terminal body and at least a portion of the electrical conductor, the tapered portion of the opening substantially preventing material comprising the sleeve from migrating beyond the narrow end of the tapered portion of the opening.

BRIEF DESCRIPTION OF THE DRAWINGS

Illustrative and presently preferred exemplary embodiments of the invention are shown in the drawings in which.

DETAILED DESCRIPTION OF THE PREFERRED EMBODIMENTS

Figure 1:
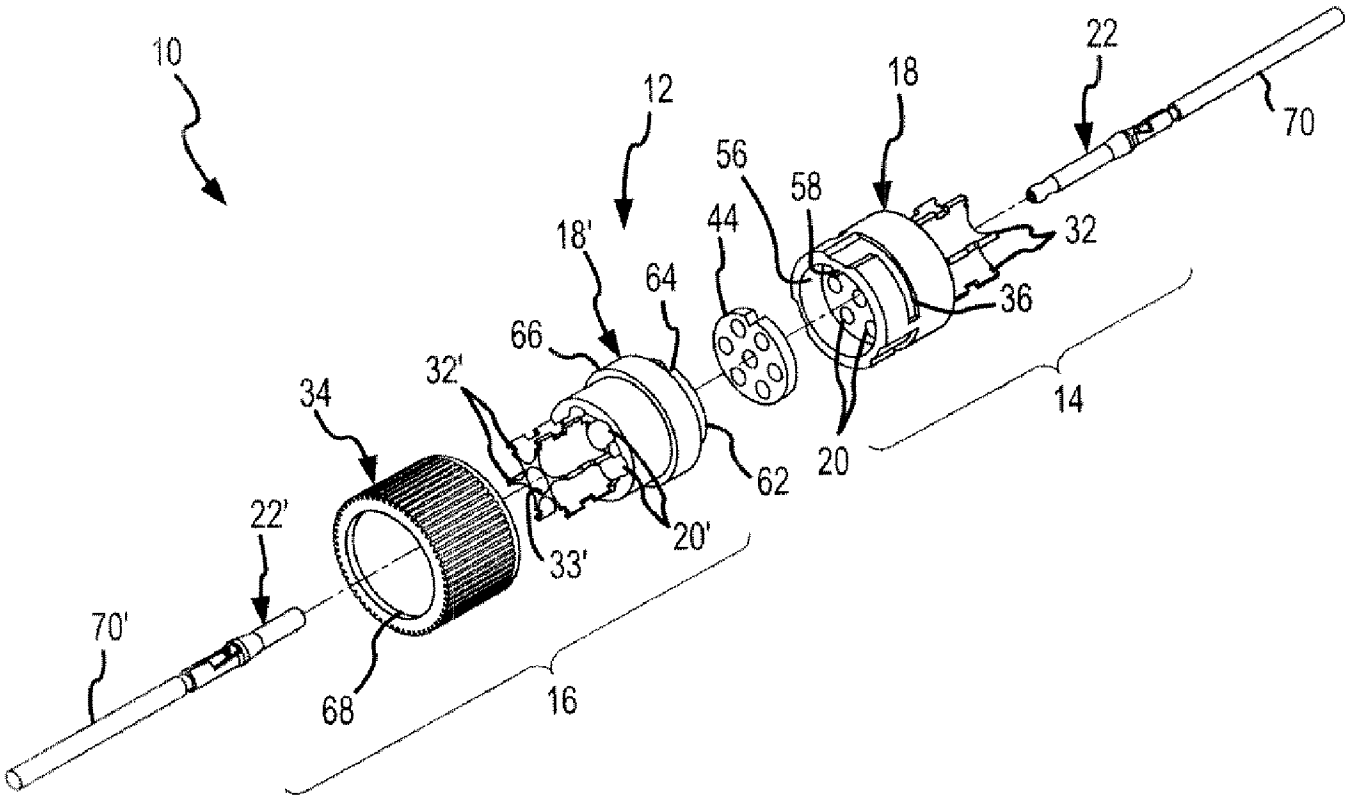
FIG. 1 is an exploded perspective view of a mating electrical connector pair according to one embodiment of the invention.

An electrical connector 10 according to one embodiment of the present invention is illustrated in FIG. 1 and may comprise both connector portions of a mating electrical connector pair 12. More specifically, a first electrical connector 10 of the mating electrical connector pair 12 may comprise a male portion 14, whereas a second electrical connector of the mating electrical connector pair 12 may comprise a female portion 16. The electrical connector 10, i.e., either the male portion 14 or the female portion 16, may comprise a terminal body (e.g., 18, 18') that defines at least one opening (e.g., 20, 20') therein sized to receive an electrical terminal (e.g., 22, 22').

Figure 3:
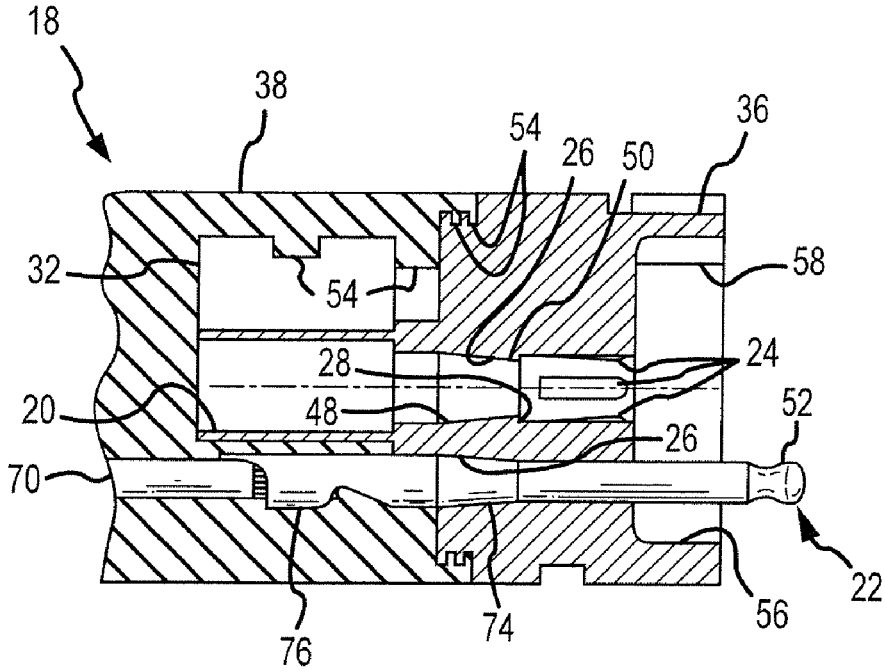
FIG. 3 is a cross-sectional view in elevation of the male terminal body taken along the line 3-3 of FIG. 2.
Figure 7:
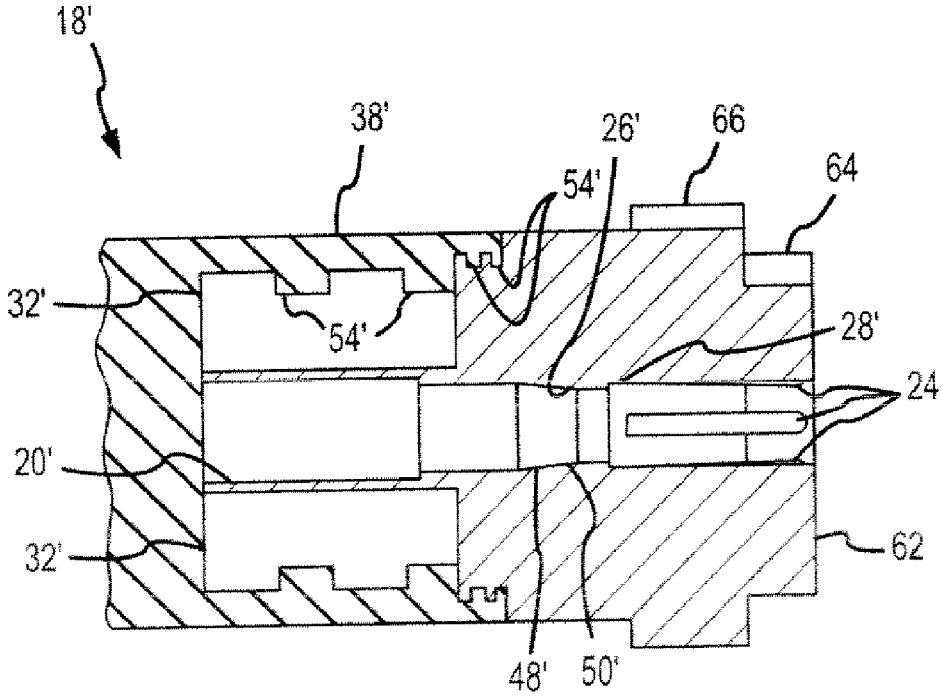
FIG. 7 is a cross-sectional view in elevation of the female terminal body taken along the line 7-7 of FIG. 6.

Referring now primarily to FIGS. 3 and 7, each opening 20, 20' defined by the terminal, body 18, 18' may be provided with a plurality of alignment ribs 24, 24'. As will be described in further detail below, the alignment ribs 24, 24' help to align the electrical terminals 22, 22' within the openings 20, 20' defined by the terminal bodies 18, 18'. The improved terminal alignment provided by the alignment ribs 24, 24' enhances the engagement of the two electrical connectors 10, i.e., the male portion 14 and the female portion 16, that comprise the mating electrical connector pair 12.

As will be described in further detail below, each terminal body 18, 18' may also be provided with additional features and elements that may be used to enhance or achieve the various objects and advantages described herein. For example, each opening 20, 20' in the terminal body 18, 18' may also be provided with a tapered portion 26, 26' comprising a wide end 48, 48' and a narrow end 50, 50'. The tapered portion 26, 26' is sized so that it receives a corresponding tapered section 74, 74' (FIGS. 11 and 12) provided on the electrical terminal 22, 22' when the terminal 22, 22' is positioned in the opening 20, 20'. Tapered portion 26, 26' also helps to center the electrical terminal 22, 22' within the opening 20, 20'. The openings 20, 20' may also be provided with a shoulder 28, 28' sized to engage a tang 30, 30' (FIGS. 11 and 12) that may be provided on the electrical terminals 22, 22'.

Each terminal body 18, 18' may also be provided with one or more separator fins 32, 32', as best seen in FIG. 1. The separator fins 32, 32' prevent the electrical terminals 22, 22' from contacting one another when in terminal body 18, 18', thereby preventing an electrical short circuit from developing between the electrical terminals 22, 22'.

In one embodiment, the mating electrical connector pair 12, which may comprise two electrical connectors 10 (i.e., the male portion 14 and the female portion 16), may be provided with a locking collar 34. As will, be described in further detail below, one or more locking tabs 46 (FIGS. 9 and 10) provided on locking collar 34 are sized to engage one or more grooved portions 36 provided on the mating electrical connector 10 (e.g., the male portion 14), thereby securely locking together the two connector portions 14 and 16 of mating electrical connector pair 12. In addition, each terminal body 18, 18' may be covered or encapsulated (e.g., by an overmolding process described in greater detail below) by a sleeve 38, 38', as best seen in FIGS. 3 and 7. As will be described in greater detail below, the provision of an overmolded sleeve 38, 38' helps to provide a good physical bond and a gas- and liquid-tight seal between sleeve 38, 38' and terminal body 18, 18'.

Figure 11:
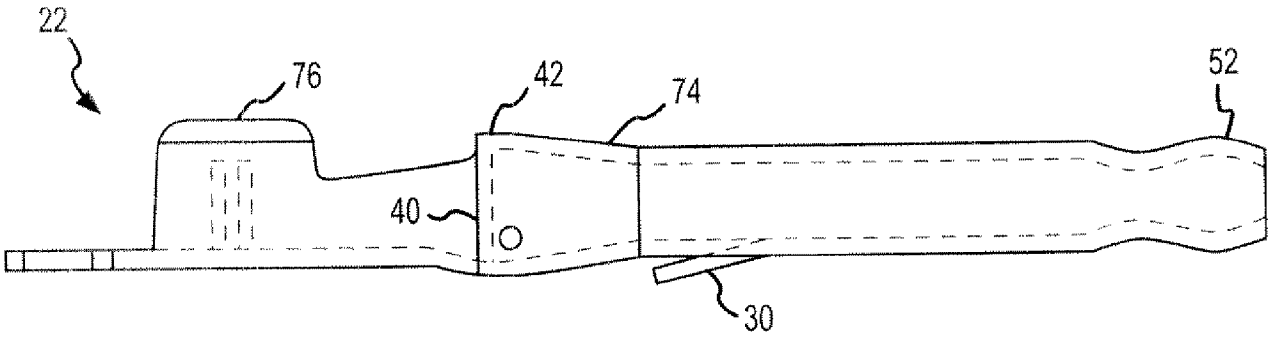
FIG. 11 is a side view of a male electrical terminal.
Figure 12:
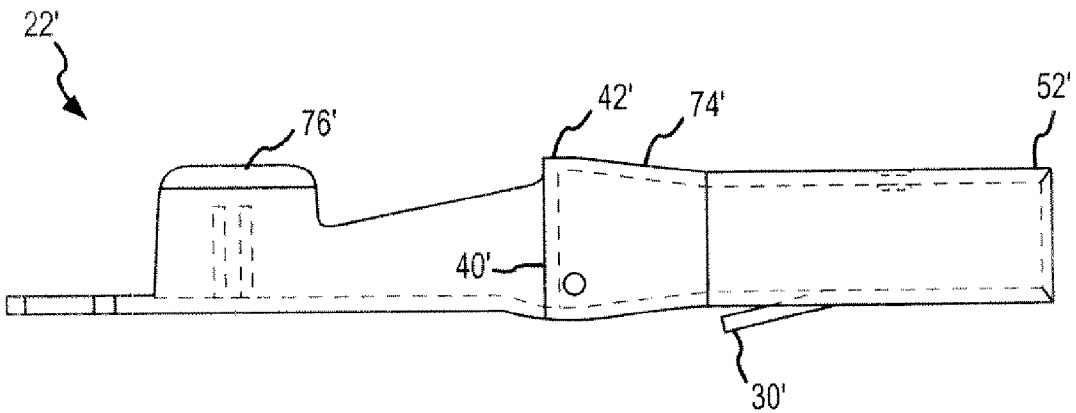
FIG. 12 is a side view of a female electrical terminal.

Referring now to FIGS. 11 and 12, in one embodiment, the electrical terminals 22, 22' may comprise plug and socket terminals having a configuration that is similar to that of conventional plug and socket connectors. However, unlike conventional connectors, the plug and socket electrical terminals 22, 22' that may be utilized in one embodiment of the present invention are provided with a tab portion 40, 40' that substantially closes a proximal end 42, 42' of the electrical terminal 22, 22'. The tab portion 40, 40' prevents the material from migrating into the hollow portion of the electrical terminal 22, 22', such as, for example, molten sleeve material during the sleeve overmolding process.

One significant feature of the electrical connector 10 of the present invention is that the alignment ribs 24, 24' provided in the openings 20, 20' defined by the terminal bodies 18, 18' help to properly align the electrical terminals 22, 22' within the terminal bodies 18, 18', thereby making it easier to engage the two portions (e.g., the male and female portions 14 and 16) of the electrical connectors 10 comprising the mating electrical connector pair 12. The enhanced alignment of the electrical terminals 22, 22' provided by the alignment ribs 24, 24' is particularly advantageous in multiple-terminal configurations, i.e., where the electrical connector 10 comprises a plurality of individual electrical terminals 22, 22'.

Still other advantages are associated with the various configurations and elements comprising the claimed invention. For example, the tapered portions 26, 26' provided in the openings 20, 20' enhance the alignment of the electrical terminals 22, 22' when they are inserted into the terminal body 18, 18' during the assembly process. That is, the tapered portions 26, 26' provide a generous "lead-in" for the terminals 22, 22'. In addition, the tapered portions 26, 26' provide for improved alignment of the electrical terminals 22, 22' when they are fully inserted into the terminal bodies 18, 18'. The cooperative engagement of the tangs 30, 30' provided on the electrical terminals 22, 22' with the shoulders 28, 28' provided in the terminal body 18, 18' helps to positively retain the electrical terminals 22, 22' within the terminal body 18, 18', helping to prevent the electrical terminals 22, 22' from becoming dislodged during subsequent connector use. Moreover, the separator fins 32, 32' provided on the terminal body 18, 18' prevent the various electrical terminals 22, 22' from contacting one another, thereby preventing electrical short circuits from developing between the electrical terminals 22, 22' contained in the terminal bodies 18, 18'.

As already briefly described, the mating electrical connector pair 12 may also be provided with a locking collar or ring 34. In one embodiment, the locking collar 34 may be used to draw together the two portions (e.g., 14 and 16) of the mating connector pair 12 to ensure a secure connection and a tight seal between the male and female portions 14 and 16, particularly where a gasket 44 (FIG. 1) is positioned between the two connector portions 14 and 16. In addition, the locking collar 34 covers the joint or interface between the electrical terminals 22, 22' of the two connector portions 14 and 16, thereby further reducing the likelihood that environmental, contaminants will find their way into the interface between the two connector portions 11 and 16.

Having briefly described one embodiment of the electrical connector 10, how it may comprise a portion of a mating electrical connector pair 12, as well as some of its more significant features and advantages, various embodiments and variations of the present invention will now be described in detail.

However, before proceeding with the detailed description, it should be noted that while the present invention is shown and described herein as it could be used in conjunction with the plug and socket type of electrical terminals, it could be utilized with other types of electrical terminals, either now known in the art or that may be developed in the future, as would become apparent to persons having ordinary skill in the art after having become familiar with the teachings provided herein. Consequently, the present invention should not be regarded as limited to the particular type of electrical terminals shown and described herein.

In addition, while the electrical connector shown and described herein comprises seven (7) separate mating electrical terminal pairs 22, 22', any number of electrical terminal pairs could be used, again as would become apparent to persons having ordinary skill in the art after having become familiar with the teachings provided herein. Consequently, the present invention should not be regarded as limited to the particular configurations and applications shown and described herein.

Referring back now to FIG. 1, one embodiment of an electrical connector 10 is shown and described herein as it could be used in conjunction with the so-called plug and socket type of electrical terminals 22, 22'. More specifically, the plug and socket type of electrical terminals may comprise two mating portions: A male terminal 22 and a female terminal 22'. See also FIGS. 11 and 12. As described herein, the electrical connector 10 that receives the male electrical terminal 22 may be referred to herein as the male portion 14, whereas the electrical connector 10 that receives the female electrical terminal 22' may be referred to herein as the female portion 16. Both the male portion 14 and the female portion 16 may be referred to herein in the alternative as simply "electrical connector 10." Because the male portion 14 is designed to mate with the female portion 16, the combination of the male and female portions 14 and 16 also may be referred to herein as the mating electrical connector pair 12.

Referring now primarily to FIGS. 2-5, the male portion 14 of the electrical connector may comprise a terminal body 18 that defines at least one opening 20 therein sized to receive electrical terminal 22. The terminal body 18 may be configured to provide electrical connections for any number of electrical terminals 22. By way of example, in the embodiment shown and described herein, the terminal body 18 defines seven (7) openings 20, thereby allowing the electrical connector 10 to provide seven (7) discrete electrical connections. Alternatively, of course, a greater or fewer number of openings 20 may be provided, depending on the desired number of electrical connections to be provided. Consequently, the present invention should not be regarded as limited to a terminal body 18 defining any particular number of openings 20.

Figure 2:
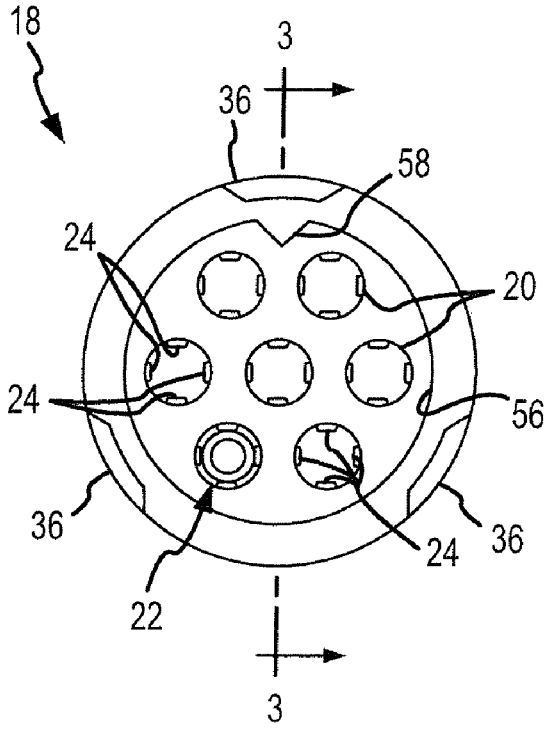
FIG. 2 is a connector-end view of a male portion of a terminal body.

Each opening 20 in terminal body 18 may be provided with a plurality of alignment ribs 24 sized and positioned so that they will position the electrical terminal 22 at the desired location (e.g., concentrically) within the opening 20. In the embodiment shown and described herein four (4) alignment ribs 24 are provided at substantially diametrically opposed locations within the opening 20, as best seen in FIG. 2. Alternatively, a greater or fewer number of alignment ribs 24 may be used and may be located at different positions depending on the number of alignment ribs 24 to be provided. For example, in another embodiment (not shown), three (3) separate alignment ribs 24 may be provided. However, instead of being diametrically opposed, the three (3) separate alignment ribs 24 may be spaced substantially evenly around the opening 20 (e.g., at 120° intervals).

Each opening 20 may also be provided with a tapered section 26 (FIG. 3). Tapered section 26 may comprise a wide end 48 and a narrow end 50. Electrical terminal 22 may be provided with a corresponding tapered section 74, as best seen in FIG. 11. Thus, when the electrical terminal 22 is inserted into the terminal body 18, the wide end 48 of tapered section 26 will serve as a lead-in for the distal end 52 (FIG. 11) of electrical terminal 22. When the electrical terminal 22 is fully inserted into terminal body 18, the narrow end 50 will contact the electrical-terminal 22, thereby helping to properly locate the electrical terminal 22 within terminal body 18.

Each opening 20 may also be provided with a shoulder 28 sized to engage a tang 30 (FIG. 11) provided on the electrical terminal 22. More specifically, shoulder 28 will engage tang 30 when the electrical terminal 22 is fully inserted into terminal body 18. The engagement of shoulder 28 and tang 30 will also prevent the electrical terminal 22 from being pushed back out from terminal body 18 during service.

Terminal body 18 may also be provided with one or more separator fins 32 that extend generally rearwardly from terminal body 18, as best seen in FIGS. 1 and 3-5. The separator fins 32 may be generally co-extensive with the electrical terminals 22 when they are fully inserted into the terminal body 18, so as to prevent the electrical terminals 22 from contacting one another.

Figure 5:
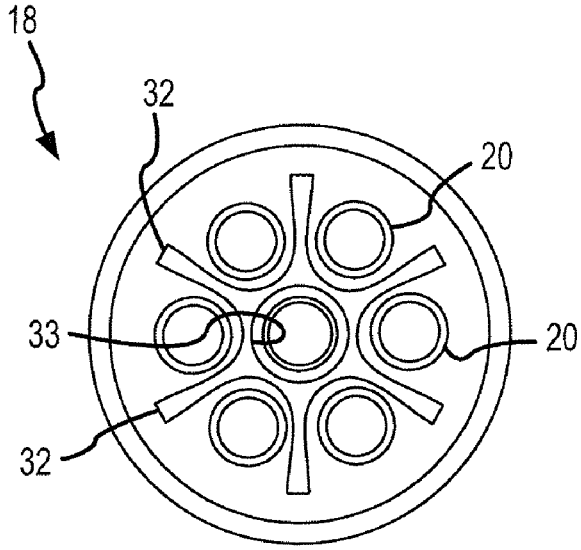
FIG. 5 is a terminal-end view of the male terminal body.

The separator fins 32 are arranged so that they are located generally between adjacent ones of the openings 20 defined in terminal body 18, as best seen in FIGS. 1 and 5. In the embodiment shown and described herein wherein the terminal body 18 is provided with seven (7) openings 20, the separator fins 32 are arranged so that they define a central opening 33 that is substantially aligned (e.g., concentric with) with the center opening 20. See FIG. 5.

Figure 4:
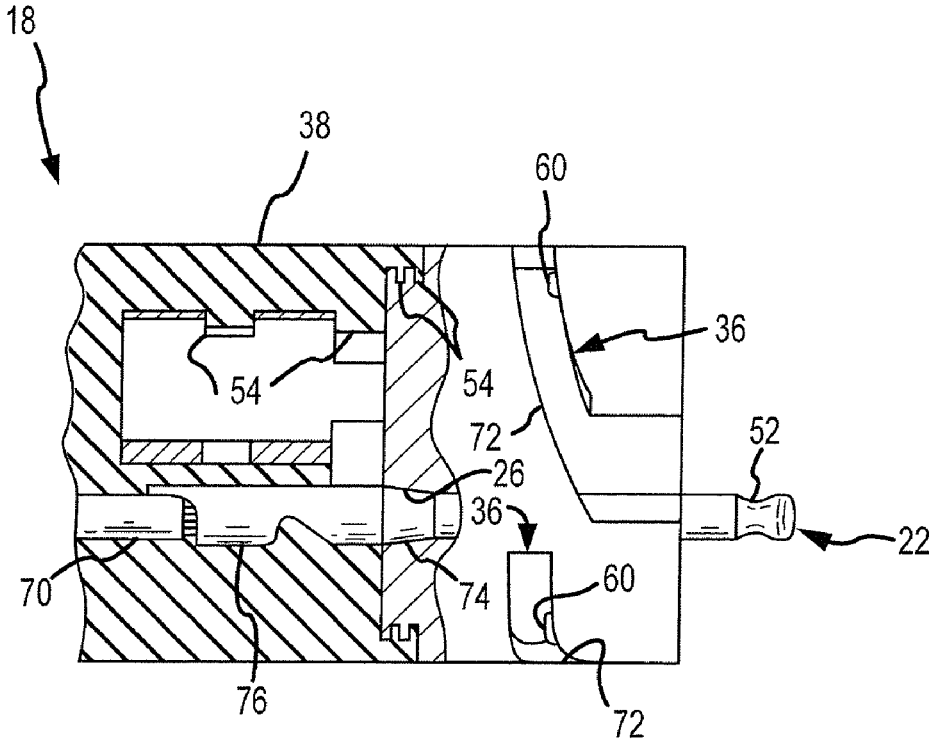
FIG. 4 is a partial sectional view of the male terminal body.

Terminal body 18 may also be provided with other features to provide the electrical connector 10 with additional advantages. For example, in one embodiment, the terminal body 18 and separator fins 32 are provided with notched sections 54 to provide a more secure attachment to the sleeve 38, as best seen in FIGS. 3 and 4. The terminal body 18 may also be provided with a recessed face portion 56. Recessed face portion 56 causes the seam or interface between the two connector portions 14 and 16 to be located within the recessed face portion 56 for the mating electrical connector pair 12, thereby reducing the likelihood that interface between the two portions 14 and 16 will be exposed to environmental contaminants. In addition, the recessed face portion 56 provides a convenient location for gasket 44 (FIG. 1) if such a gasket is desired.

Recessed face portion 56 may be provided with an index feature, such as a V-shaped projection 58 (FIGS. 2 and 3) sized to receive a corresponding V-shaped notch 64 (FIGS. 6 and 7) which may be provided in the mating electrical connector 10 (e.g., female portion 16). The index feature provides a convenient way to align the connectors to ensure proper connection of the electrical terminals 22, 22'.

Terminal body 18 of electrical connector 10 may also be provided with one or more grooves or grooved sections 36 sized to engage a locking collar 34 that may be provided on the mating terminal body. See FIGS. 1-4. In the embodiment shown and described herein, three (3) separate grooved sections 36 are provided around the exterior or outer periphery of terminal body 18 at 120° intervals, as best seen in FIGS. 1 and 2. Alternatively, a greater or fewer number of grooved sections 36 may be used and may be provided at different spacings or intervals. The grooved sections 36 are sized to receive corresponding locking tabs 46 (FIG. 9) provided on locking collar 34. In addition, one or more of the grooved sections 36 may be provided with a detent 60 (FIG. 4) configured to engage the locking nabs 46 provided on locking collar 34. The engagement of the locking tabs 46 with the detents 60 provides a positive locking action for the locking collar 34. That is, the detents 60 help to secure the locking collar 34 in the fully engaged or locked position.

The terminal body 18 and the various features and components thereof may be fabricated from any of a wide range of materials, such as plastics or other non-conductive materials, that would be suitable for the intended application. Consequently, the present invention should not be regarded as limited to a terminal body 18 fabricated from any particular type of material. However, by way of example, in one embodiment, the terminal body 18 is molded as a single, unitary piece from nylon "66."

Figure 6:
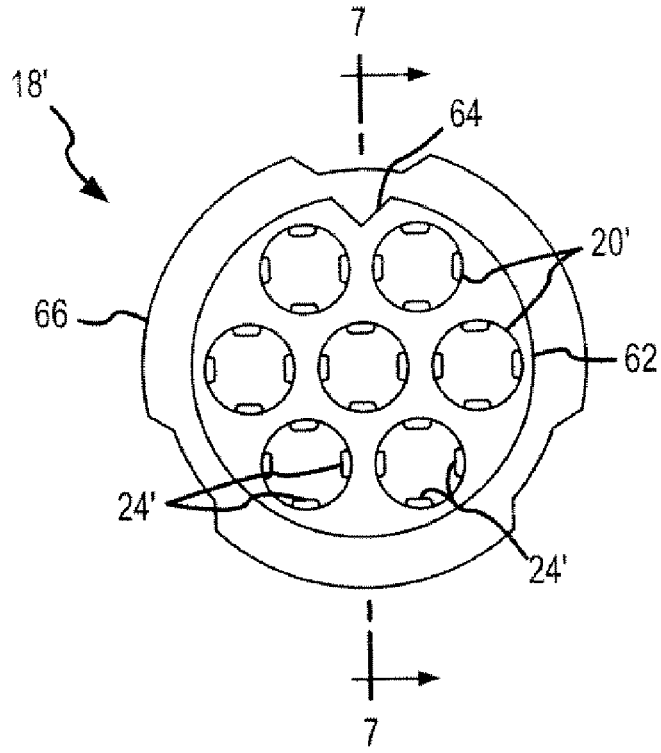
FIG. 6 is a connector-end view of a female portion of a terminal body.
Figure 8:
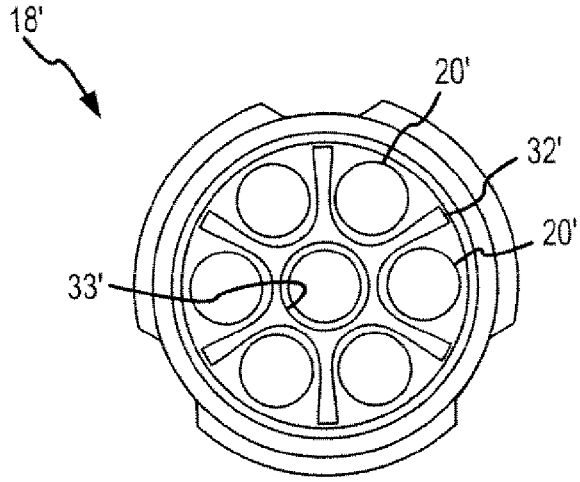
FIG. 8 is a terminal-end view of the female terminal body.

Referring now primarily to FIGS. 6-8, a female portion 16 of an electrical connector 10 may be designed to engage or mate with the male portion 14 of the electrical connector lust described. The female portion 16 may comprise a terminal body 18' that defines one or more openings 20' therein. The numbers, sizes, and spacings of the openings 20' may be configured to correspond to the numbers, sizes, and spacings of the openings 20 provided in the terminal body 18 for the male portion 14 of electrical connector 10. For example, in the embodiment shown and described herein, the terminal body 18' defines seven (7) openings 20' therein in the manner illustrated in FIGS. 1 and 6-8.

Each opening 20' may be provided with features similar to those provided in openings 20 of terminal body 18. For example, and with reference now to FIG. 1, each opening 20' may be provided with a plurality of alignment ribs 24'. Alignment ribs 24' may be substantially identical to the alignment ribs 24, thus will not be described in further detail herein.

Each opening 20' may also be provided with a tapered section 26' having a wide end 48' and a narrow end 50' that are sized to receive a tapered section 74' (FIG. 12) provided on the mating (e.g., female) electrical terminal 22' in a manner similar to that already described for the tapered section 26. Opening 20' may also be provided with a shoulder 28' sized to engage a tang 30' provided on female electrical terminal 22'.

As was the case for the male portion 14 of the electrical connector 10, the terminal body 18' of female portion 16 of electrical connector 10 may be provided with one or more separator fins 32'. The separator fins 32' may extend generally rearwardly from the terminal body 18' so that the are co-extensive with the electrical terminals 22' when the electrical terminals 22' are fully inserted in terminal body 18'. In the embodiment shown and described herein wherein the terminal body 18' is configured with seven (7) openings 20', the separator fins 32' are arranged so that they define a central opening 33' that is substantially aligned with the opening 20' provided at or near the center of the terminal body 18'. See FIGS. 1 and 8.

With reference now primarily to FIG. 7, the terminal body 18' and separator fins 32' may be provided with notched areas or sections 54' to provide a more secure attachment for sleeve 38'. Terminal body 18' may also be provided with a raised or extended face section 62 that is sized to be received by the recessed face portion 56 of terminal body 18, as best seen in FIG. 1. The raised face section 62 and recessed face 56 may be configured to interface with gasket 44, as best seen in FIG. 1. In addition, the raised face section 62 may be provided with an index feature, such as a V-shaped notch 64 (FIG. 6) that is sized to mate with or engage the corresponding index feature (e.g., the V-shaped projection 58) provided on the mating terminal body 18.

Terminal body 18' may also be provided with a raised shoulder or boss 66 that engages with a similar shoulder 68 provided on locking collar 34. The engagement, of the two shoulders 66 and 68 allows the locking collar 34 to securely hold together the two connector portions 14 and 16 when they are engaged with one another and when the locking collar 34 is rotated to the locked position.

Terminal body 18' may be fabricated from any of a wide range of materials, such as plastics or other non-conductive materials, that would be suitable for the intended application. Consequently, the present invention should not be regarded as limited to any particular type of material. However, by way of example, in one embodiment, terminal body 18' is molded as a single, unitary piece from nylon "66."

As already discussed herein, it may be generally desirable to provide each terminal body 18, 18' with a sleeve 38, 38'. Sleeves 38, 38' may provide a good physical bond as well as a gas- and liquid-tight seal with the terminal bodies 18, 18' and wires 70, 70' thereby providing for enhanced protection against environmental encroachment. In addition, sleeves 38, 38' may be configured or shaped to provide an enhanced gripping area for a user. While the sleeves 38, 38' may comprise a separate component or element that is fitted over the terminal bodies 18, 18', in many applications it will be generally desirable to form or mold the sleeves 38, 38' directly on the terminal bodies 18, 18' after the terminal bodies 18, 18' have been assembled, i.e., after the various electrical terminals 22, 22' have been inserted into the openings 20, 20' provided in terminal bodies 18, 18'.

In one embodiment, the sleeves 38, 38' are formed over the terminal bodies 18, 18' by an "overmolding" process of the type known in the art. So forming the sleeves 38, 38' by such an overmolding process allows a robust seal (e.g., a gas- and liquid-tight seal) to be established between the terminal bodies 18, 18', the electrical conductors or wires 70, 70', and the sleeves 38, 38'.

More specifically, after the terminal bodies 18, 18' have been assembled, they may be positioned in a form or mold (not shown) suitable for defining or forming the sleeves 38, 38' Material (e.g., molten material) that will comprise the sleeves 38, 38' may then be injected under pressure into the form or mold. During the molding process, the injected material will flow around the various components of the assembled terminal bodies 18, 18', substantially encapsulating portions of the terminal bodies 18, 18' portions of the electrical conductors (i.e., wires) 70, 70', and portions of the electrical terminals 22, 22', such as, for example, the crimp sections 76, 76' thereof, as best seen in FIGS. 3 and 4. Significantly, the closed proximal ends 42, 42' of electrical terminals 22, 22' (e.g., formed by the respective tab portions 40, 40' thereof), prevent molten sleeve material from flowing or migrating into the hollow portions of the electrical terminals 22, 22' during the molding process. In addition, the engagement of the tapered sections 74, 74' of the electrical terminals 22, 22' with the corresponding tapered portions 26, 26' of terminal bodies 18, 18' also prevents molten sleeve material from flowing or migrating beyond the narrow ends 50, 50' to tapered portions 26, 26' during the molding process.

Sleeves 38, 38' may be fabricated from any of a wide range of materials (e.g., plastics) suitable for the particular application and for the particular process (e.g., overmolding) used to form the sleeves 38, 38'. Consequently, the present, invention should not be regarded as limited to sleeves 38, 38' formed from any particular type of material. However, by way of example, in one embodiment, sleeves 38 and 38' are formed from a PVC (polyvinylchloride) plastic material.

Figure 9:
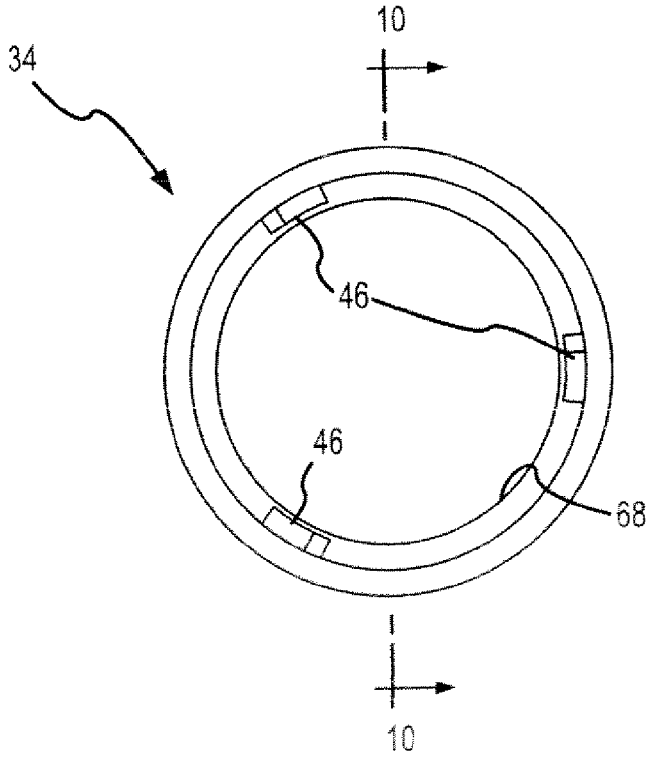
FIG. 9 is an end view of a locking collar.
Figure 10:
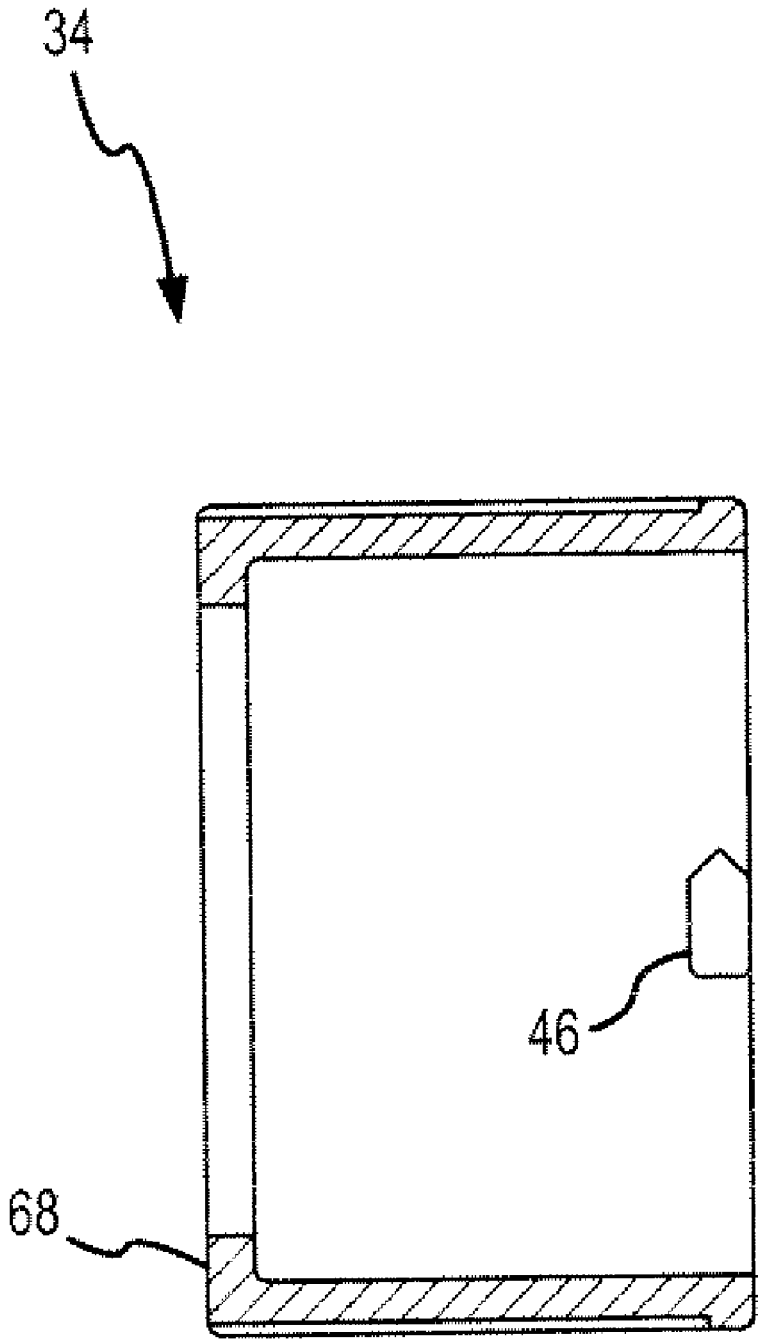
FIG. 10 is a cross-sectional view in elevation of the locking collar taken along the line 10-10 of FIG. 9.

Turning now to FIGS. 1, 9, and 10, locking collar 34 may be used to securely hold together the male and female portions 14 and 16 of the mating electrical connector pair 12. In the embodiment shown and described herein, locking collar 34 may comprise a generally hollow, cylindrically shaped member having one or more locking tabs 46 provided thereon. Locking collar 34 may also be provided with a shoulder section 68 sized to engage a similar shoulder or boss 66 provided on terminal body 18', as already described. Once the male and female portions 14 and 16 are fully mated together, locking collar 34 may be rotated as necessary to align the locking tabs 46 with the with the grooves 36 provided on the mating terminal body (e.g., terminal body 18). Locking collar 34 is then moved axially toward the mating terminal body 18 until the locking tabs 46 engage the inclined sections 72 (FIG. 4) of grooves 36. Locking collar 34 is then rotated. The engagement of the locking tabs 46 with the inclined sections 72 of grooves 36 causes the two connector portions 14 and 16 to be drawn together as the locking collar is rotated toward the locked position. When rotated to the locked position, the connector portions 14 and 16 will be fully drawn together and the locking tabs 46 will engage the detents 60 provided on grooves 36, thereby holding the locking collar 34 in the locked position.

Locking collar 34 may be fabricated from any of a wide range of materials, such as metals or plastics, suitable for the intended application. By way of example, in one embodiment, locking collar 34 is fabricated from nylon "66," although other materials could be used as well.

The electrical terminals 22, 22' that may be utilized in one embodiment of the invention are best seen in FIGS. 1, 11, and 12. In one embodiment, the electrical terminals 22, 22' may comprise a size and configuration that is consistent with the connector standard that is well-known in the art. Alternatively, other types of electrical terminals, either now known in the art or that may be developed in the future, may be used. Referring now primarily to FIG. 11, a male-type electrical terminal 22 may comprise a generally elongate, hollow structure having a proximal end 42 and a distal end 52. The proximal end 42 of male electrical terminal 22 may be provided with a tapered section 74 sized to be received by the tapered portion 26 provided in the opening 20 of terminal body 18 (FIG. 3) in the manner already described. Electrical terminal 22 may also be provided with a tang 30 sized and positioned to engage the shoulder 28 provided in the opening 20 of terminal body 18. Proximal end 42 of male electrical terminal 22 may also be provided with a suitable crimp section 76 for allowing the electrical conductor of a wire 70 (FIG. 1) to be crimped (i.e., connected) to the electrical terminal 22.

The proximal end 42 of male electrical terminal 22 is also provided with a tab 40 that substantially closes the proximal end 42 of the electrical terminal 22. The tab 40 prevents unwanted material from migrating into the hollow portion of the electrical terminal 22, thereby enhancing the reliability and durability of the electrical connector. The presence of the tab 40 is particularly beneficial in situations wherein the sleeve 38 is formed by the overmolding process already described. That is, tab 40 prevents molten sleeve material from migrating into the hollow portion of the electrical terminal 22.

A female type of electrical terminal 22' is best seen in FIGS. 1 and 12 and may comprise a generally elongate, hollow structure having a proximal end 42' and a distal end 52'. The proximal end 42' of female electrical terminal 22' may be provided with a tapered section 74' sized to be received by the tapered portion 26' provided in the opening 20' of terminal body 18' (FIG. 7). Electrical terminal 22' may also be provided with a tang 30' sized and positioned to engage the shoulder 28' provided in the opening 20' of terminal body 18' Proximal end 42' of female electrical terminal 22' may also be provided with a suitable crimp section 76' for allowing the electrical conductor of a wire 70' (FIG. 1) to be connected to the electrical terminal 22'.

The proximal end 42' of female electrical terminal 22' is also provided with a tab 40' that substantially closes the proximal end 42' of the electrical terminal 22'. The tab portion 40' prevents unwanted material from migrating into the hollow portion of the electrical terminal 22', thereby enhancing the durability and reliability of the electrical connector. The presence of the tab 40' is particularly beneficial in situations wherein the sleeve 38' is formed by the overmolding process already described. That is, tab 40' prevents molten sleeve material from migrating into the hollow portion of the electrical terminal 22'.

The male and female electrical terminals 22 and 22' may be fabricated from any of a wide range of electrically conductive materials and in accordance with any of a wide range of fabrication processes, as would become apparent to persons having ordinary skill in the art after having become familiar with the teachings provided herein. However, by way of example, in one embodiment, each electrical terminal 22, 22' may be fabricated from a generally flat sheet of material (e.g., metal) that includes features and elements that, when elastically deformed or bent, will form the generally elongate hollow terminal having the desired configuration. In addition, the sheet of material may comprise a tab portion (e.g., 40, 40') that can be bent or elastically deformed so as to substantially close the proximal end of the electrical terminal 22, 22' in the manner already described and best seen in FIGS. 11 and 12.

Having herein set forth preferred embodiments of the present invention, it is anticipated that suitable modifications can be made thereto which will nonetheless remain within the scope of the invention. The invention shall therefore only be construed in accordance with the following claims.

The invention claimed is:

1. An electrical connector, comprising:

a terminal body, said terminal body defining an opening therein, the opening comprising a front portion having a plurality of alignment ribs, the opening also comprising a tapered portion having a wide end and a narrow end that extends from the front portion and being smaller than the front portion;

an electrical terminal comprising a generally elongate, hollow structure having a proximal end and a distal end, said electrical terminal having a crimp section extending from the proximal end of the generally elongate, hollow structure, said proximal end of the generally elongate, hollow structure being closed, the distal end of said electrical terminal being sized to engage a mating electrical terminal, the generally elongate, hollow structure also having a tapered section formed therein located between the proximal and distal ends of the generally elongate, hollow structure, the tapered section of the generally elongate, hollow structure being sized to engage the tapered portion in the opening of said terminal body, said electrical terminal being positioned within the opening in said terminal body, said plurality of alignment ribs aligning said electrical terminal within the opening in said terminal body;

an electrical conductor electrically connected to the crimp section of said electrical terminal; and a sleeve formed around said terminal body by a molding process so that said sleeve encapsulates at least a portion of said terminal body, at least a portion of said electrical conductor, and at least a portion of said electrical terminal, the closed proximal end of said electrical terminal substantially preventing sleeve material from migrating into the distal end of said electrical terminal during the molding process, the engagement of the tapered section of said electrical terminal with the tapered portion of the opening in said terminal body substantially preventing sleeve material from migrating beyond the narrow end of the tapered portion of the opening during the molding process.

2. The electrical connector of claim 1, wherein said terminal body defines at least one notched section on the exterior thereof, said sleeve engaging the notched section.

3. The electrical connector of claim 2, wherein said terminal body comprises a nylon material.

4. The electrical connector of claim 3, wherein said sleeve comprises a polyvinylchloride material.

5. The electrical connector of claim 1, wherein said terminal body defines a plurality of openings therein sized to receive a plurality of electrical terminals, said terminal body further comprising at least one separator fin located between adjacent openings defined in said terminal body and extending outwardly therefrom, said at least one separator fin preventing adjacent ones of said electrical terminals from contacting one another.

6. The electrical connector of claim 1, wherein said electrical terminal comprises a tang and wherein said opening defined in said terminal body comprises a shoulder sized to engage the tang on said electrical terminal, the engagement of the tang and the shoulder preventing said electrical terminal from being removed from said opening.

7. The electrical connector of claim 1, wherein said terminal body comprises an index feature thereon.

8. The electrical connector of claim 7, wherein said index feature comprises a V-shaped notch.

9. A mating electrical connector pair, comprising a first terminal body, said first terminal body defining an opening therein comprising a front portion having a plurality of alignment ribs, the opening also comprising a tapered portion having a wide end and a narrow end that extends from the front portion and being smaller than the front portion;

a first type of electrical terminal comprising a generally elongate, hollow structure having a proximal end and a distal end, said first type of electrical terminal having a crimp section extending from the proximal end of the generally elongate, hollow structure, said proximal end of the generally elongate, hollow structure being closed, the generally elongate, hollow structure also having a tapered section formed therein located between the proximal and distal ends of the generally elongate, hollow structure, the tapered section of the generally elongate, hollow structure being sized to engage the tapered portion in the opening in said first terminal body, said first type of electrical terminal being positioned within the opening in said first terminal body, said plurality of alignment ribs aligning said first type of electrical terminal within the opening in said first terminal body;

a first electrical conductor electrically connected to the crimp section of said first type of electrical terminal;

a first sleeve formed around said first terminal body by a molding process so that said first sleeve encapsulates at least a portion of said first terminal body, at least a portion of said first electrical conductor, and at least a portion of said first type of electrical terminal, the closed proximal end of said first type of electrical terminal substantially preventing sleeve material from migrating into the distal end of said first type of electrical terminal during the molding process, the engagement of the tapered section of said first type of electrical terminal with the tapered portion of the opening in said first terminal body substantially preventing sleeve material from migrating beyond the narrow end of the tapered portion of the opening during the molding process;

a second terminal body, said second terminal body defining an opening therein comprising a front portion and a tapered portion having a wide end and a narrow end that extends from the front portion and being smaller than the front portion;

a second type of electrical terminal comprising a generally elongate, hollow structure having a proximal end and a distal end, said second type of electrical terminal having a crimp section extending from the proximal end of the generally elongate, hollow structure, said proximal end of the generally elongate, hollow structure being closed, the generally elongate, hollow structure also having a tapered section formed therein located between the proximal and distal ends of the generally elongate, hollow structure, the tapered section of the generally elongate, hollow structure being sized to engage the tapered portion in the opening in said second terminal body, said second type of electrical terminal being positioned within the opening of said second terminal body, said second type of electrical terminal being releasably engageable with said first type of electrical terminal;

a second electrical conductor electrically connected to the crimp section of said second type of electrical terminal; and a second sleeve formed around said second terminal body by a molding process so that said second sleeve encapsulates at least a portion of said second terminal body, at least a portion of said second electrical conductor, and at least a portion of said second type of electrical terminal, the closed proximal end of said second type of electrical terminal substantially preventing sleeve material from migrating into the distal end of said second type of electrical terminal during the molding process, the engagement of the tapered section of said second type of electrical terminal with the tapered portion of the opening in said second terminal body substantially preventing sleeve material from migrating beyond the narrow end of the tapered portion of the opening during the molding process.

10. The mating electrical connector pair of claim 9, further comprising a plurality of alignment ribs in the opening defined in said second terminal body, said plurality of alignment ribs aligning said second type of electrical terminal within the opening in said second terminal body.

11. The mating electrical connector pair of claim 10, wherein said second terminal body comprises a recessed face portion sized to receive at least a portion of said first terminal body.

12. The mating electrical connector pair of claim 11, wherein said second type of electrical terminal extends beyond the recessed face portion of said second terminal body.

13. The mating electrical connector pair of claim 12, wherein said first type of electrical terminal comprises a female terminal and wherein said second type of electrical terminal comprises a male terminal.

14. The mating electrical connector pair of claim 9, further comprising a locking collar operatively associated with said first terminal body, said locking collar having at least one locking tab thereon, and wherein said second terminal body comprises a groove therein sized to receive the at least one locking tab on said locking collar, said locking collar being rotatable between a locked position and an unlocked position when said first and second types of electrical terminal are engaged with one another.

15. The mating electrical connector pair of claim 14, further comprising a gasket provided between said first terminal body and said second terminal body, said gasket being compressed when said locking collar is in the locked position and when said first and second types of electrical terminal are engaged with one another.

16. The mating electrical connector pair of claim 15, wherein the groove on said second terminal body comprises a detent thereon, said detent engaging the locking tab on said locking collar when said locking collar is in the locked position.

17. The mating electrical connector pair of claim 16, wherein said first terminal body comprises an indexing notch thereon and wherein said second terminal body comprises an indexing projection thereon, said indexing projection engaging said indexing notch when said first and second terminal bodies are in a connected position.

* * * * *